US005669706A

United States Patent [19]

Chen

[11] Patent Number: 5,669,706

[45] Date of Patent: Sep. 23, 1997

[54] TURN-ON-AND-OFF DEVICE FOR A FLASHLIGHT

[76] Inventor: Chin-Hsiang Chen, No. 32 Lane 398, Fu Chiang Rd. Sec 2, Yung Kang Hsiang, Tainan Hsiang, Taiwan

[21] Appl. No.: 622,712

[22] Filed: Mar. 26, 1996

[51] Int. Cl.[6] ..... F21L 1/00

[52] U.S. Cl. ..... 362/203; 362/202; 362/205

[58] Field of Search ..... 362/187, 188, 362/202, 203, 205, 208

[56] References Cited

U.S. PATENT DOCUMENTS 2,912,567 11/1959 Dulgerg ..... 362/203
4,339,788 7/1982 White et al. ..... 362/205
5,124,894 6/1992 Shiau ..... 362/187
5,213,408 5/1993 Shiau ..... 362/203

*Primary Examiner*—Alan Cariaso
*Attorney, Agent, or Firm*—Pro-Techtor International

[57] ABSTRACT

A turn-on-and-off device for a flashlight includes an actuating disc located in front of a casing. The actuating disc has a center hole for a lamp to pass through and three posts extending laterally rearward to pass through three position holes in a front end wall of the casing. The actuating disc can be moved by a lamp housing being screwed to move forward and rearward. When the actuating disc is in a forward position, the three posts permit the foremost battery to contact with the lamp bottom to let the lamp lit up. When the actuating disc is in a rearward position, the three posts push rearward the foremost battery, which is then separated from the lamp, which is then turned off.

2 Claims, 7 Drawing Sheets

TURN-ON-AND-OFF DEVICE FOR A FLASHLIGHT

BACKGROUND OF THE INVENTION

This invention concerns a turn-on-and-off device for a flashlight, particularly having a simple structure to function so as to lower its cost.

A traditional flashlight has many components including a switch base fixed inside a casing, needing much work in assembling. And turning-on-and-off function is performed by moving forward and rearward the switch base.

SUMMARY OF THE INVENTION

The purpose of the invention is to offer a turn-on-and-off device for a flashlight, which includes an actuating disc with three lateral posts movably fixed with a lamp housing, which is able to screw with a front end section of a casing so as to move forward and rearward relative to the casing. The three lateral posts pass through three position holes in a front side surface of the casing to extend in an interior of the casing. When the lamp housing is in a forward position, the bottom of a lamp contacts with the positive pole of the foremost battery housed in the casing and elastically pushed by a spiral spring rested on a tail cap and is lit up, that is, turned on. But when the lamp housing is moved to a rearward position by screwing it relative to the casing, the lamp is separated from the positive pole of the foremost battery, which is pushed rearward by the three lateral posts of the actuating disc moved together with the lamp housing. Then the lamp is turned off.

BRIEF DESCRIPTION OF DRAWINGS

This invention will be better understood by reference to the accompanying drawings, wherein.

DESCRIPTION OF THE PREFERRED EMBODIMENTS

Figure 1:
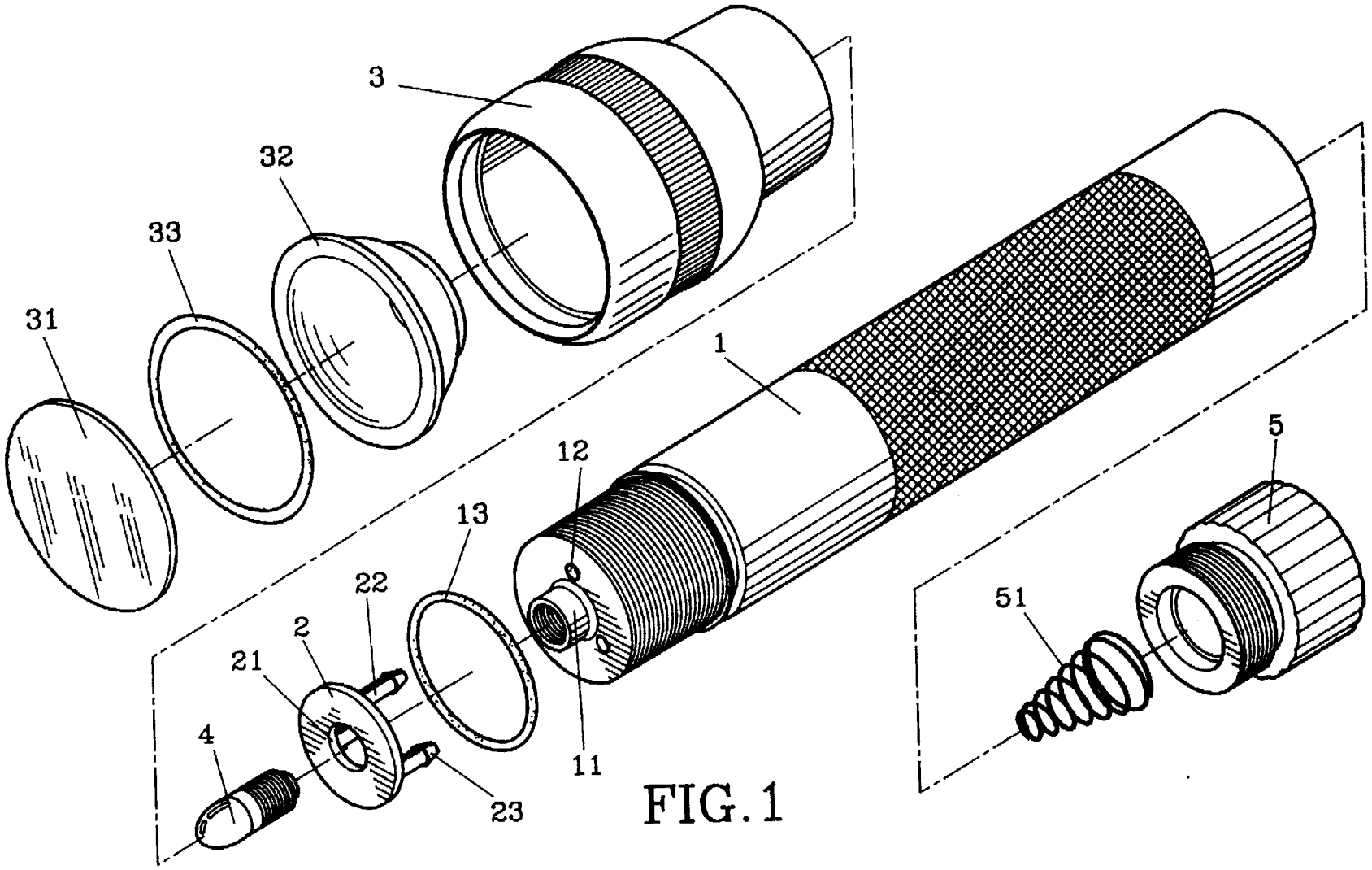
FIG. 1 is an exploded perspective view of a first embodiment of a turn-on-and-off device for a flashlight in the present invention.

A first embodiment of a turn-on-and-off device for a flashlight in the present invention, as shown in FIG. 1, includes a casing 1, an actuating disc 2, a lamp housing 3, a lamp 4 and a tail cap as main components.

Figure 4:
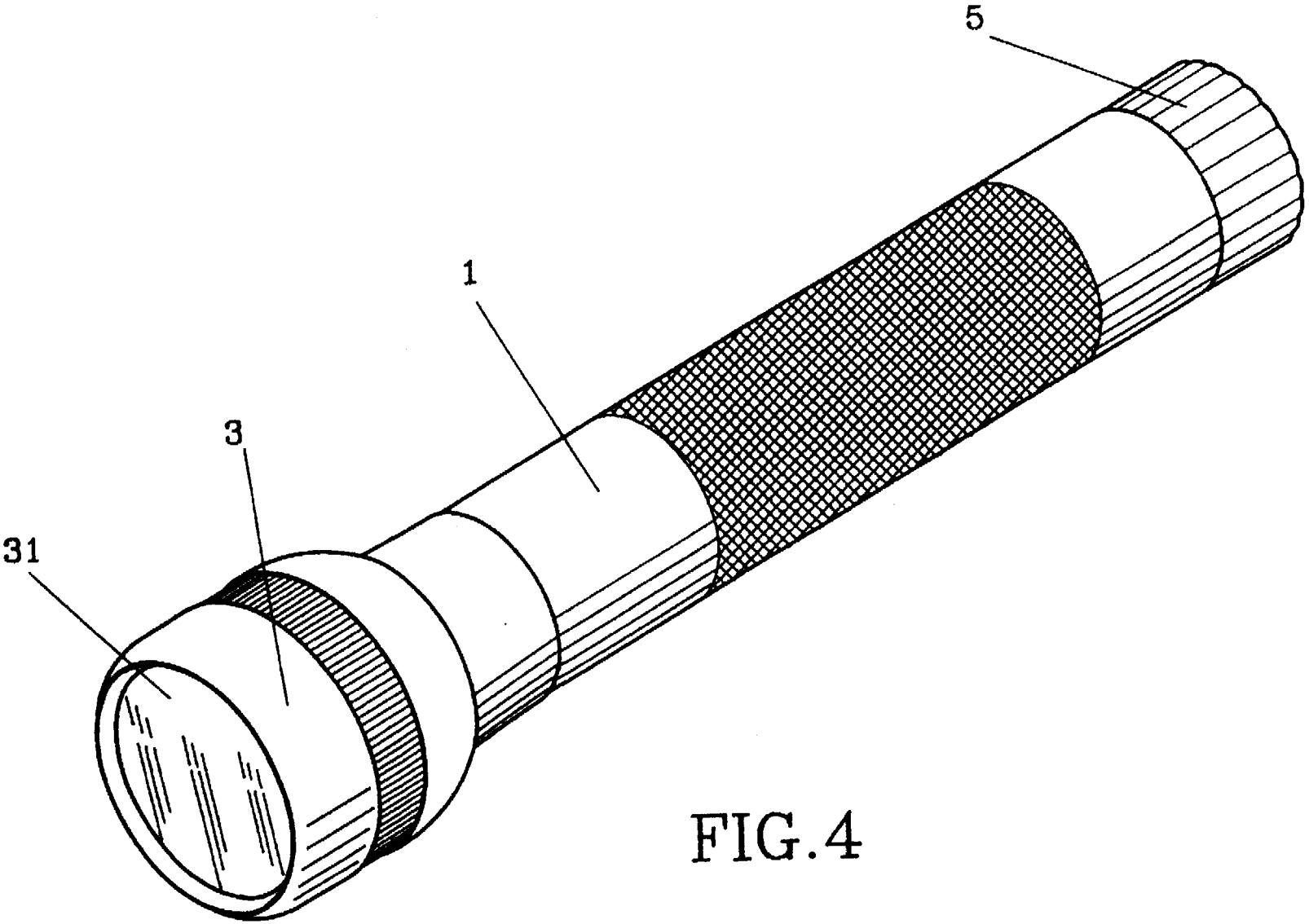
FIG. 4 is a perspective view of the first embodiment of a turn-on-and-off device for a flashlight in the present invention.

The casing 1, as shown in FIG. 4, has a proper length for housing batteries 40, a lamp holder 11 fixed at a front end and having an annular female-threaded short tube for a lamp 4 to screw with, and three position holes 12 spaced apart equidistantly in the front end surface between the lamp holder 11 and a peripheral edge for three posts 22 of the actuating disc 3 to fit and be secured therein.

Figure 2:
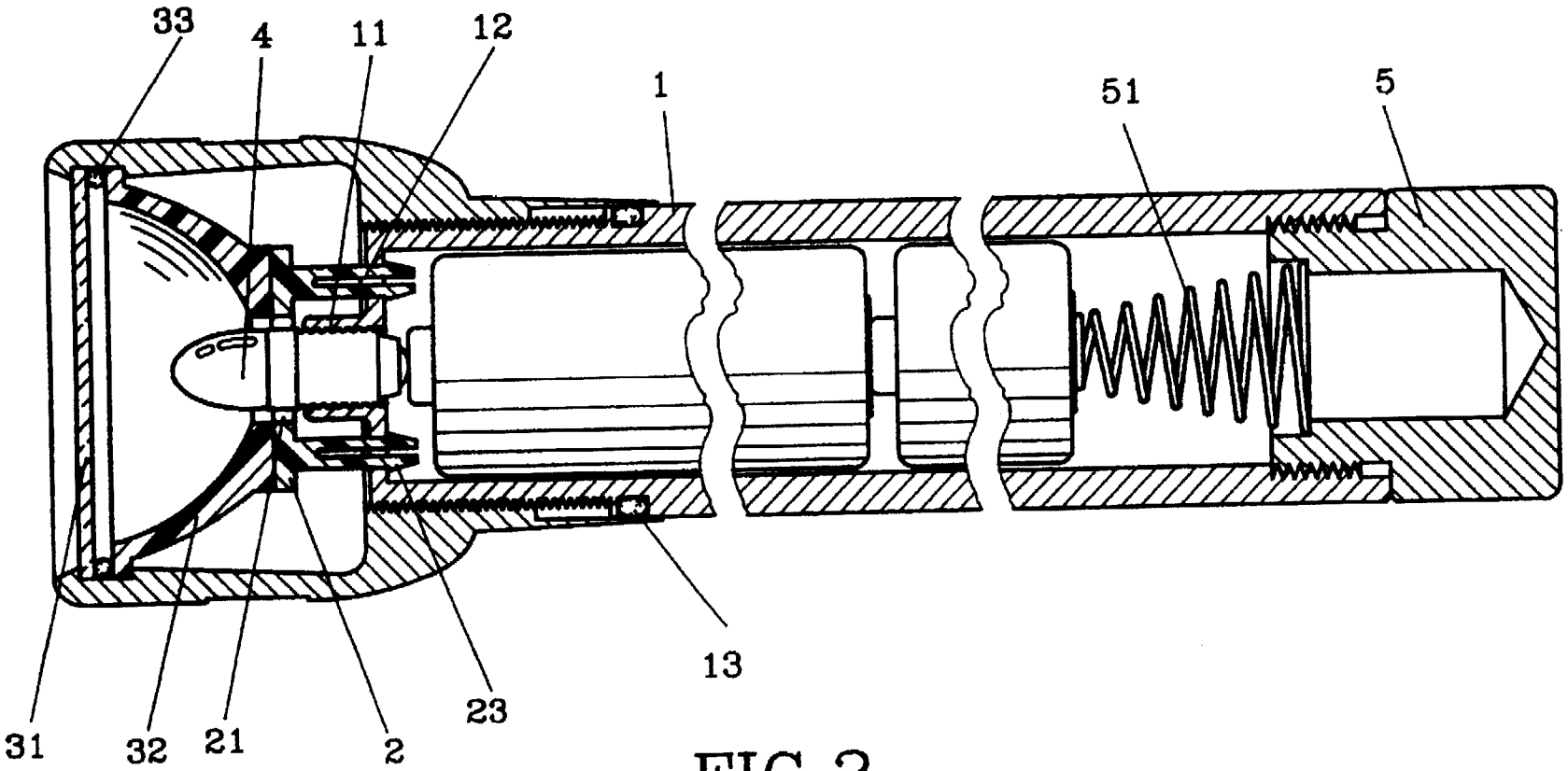
FIG. 2 is a cross-sectional view of the first embodiment of a turn-on-and-off device for a flashlight in the present invention, showing it being in turn-on condition.
Figure 3:
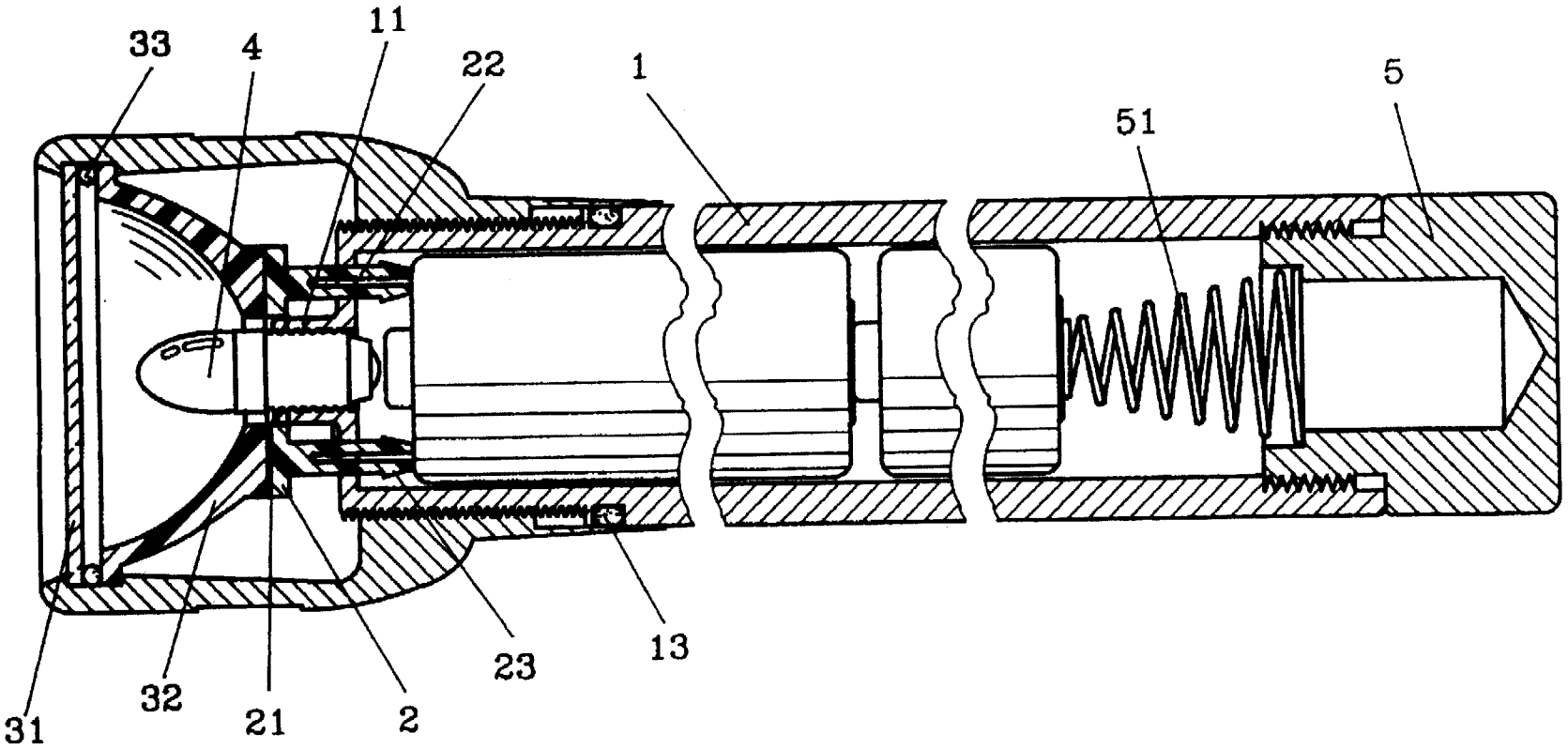
FIG. 3 is a cross-sectional view of the first embodiment of a turn-on-and-off device for a flashlight in the present invention, showing it being in turned-off condition.

The actuating disc 2, as shown in FIGS. 1, 2 and 3, has a center hole 21 for the lamp 4 to pass through, and three posts 22 extending laterally rearward and spaced apart equidistantly. Each post 22 has a little larger diameter annular projection 23 near its end so that the three posts 22 may be movably positioned thereby after inserted in the position holes 12 of the casing 1 and extending in the interior of the casing 1. Then the actuating disc 2 with the three posts 22 is movable forward and rearward.

The lamp housing 3 includes a lens 31, a parabolically-shaped reflector and a gasket 33 as that of a conventional flashlight does, and screwed with a front end section of the casing 1 to move rearward and forward, but it is omitted in its description here as it is well-known structure.

The tail cap 5 screws with the rear end of the casing 1 and receiving a spiral spring 51, which is to elastically urge the bottom of the rearmost battery 40, and the structure of the tail cap 5 and the spiral spring 51 are also well-known art, omitted in its description here.

After the batteries 40 are inserted in the interior of the casing 1 from the bottom side, the tail cap 5 with the spiral spring 51 is combined with the casing 1, being screwed with the bottom end of the casing 1 until the tail cap 5 reaches the position shown in FIG. 2.

Turning on and off power for the lamp 4 is effected by rotating the lamp housing 3, which is then moved from a turn-off position shown in FIG. 3 to a turn-on position shown in FIG. 2 or vice versa. Then the actuating disc 2 is pushed forward by the parabolically-shaped reflector 32 together with the lamp housing 3, with the three posts moving forward, from the turn-off position to the turn-on position, wherein the bottom of the lamp 4 contacts with the positive pole of the foremost battery 40 pushed by the spring 51, or vice versa, and the actuating disc 2 is pushed rearward by the lamp housing 3 with the reflector 32, with the three posts 22 pushed rearward at the same time from the turn-on position to the turn-off position, wherein the lamp 4 is separated from the positive pole of the foremost battery 40, that is, the lamp 4 is turned off.

Figure 5:
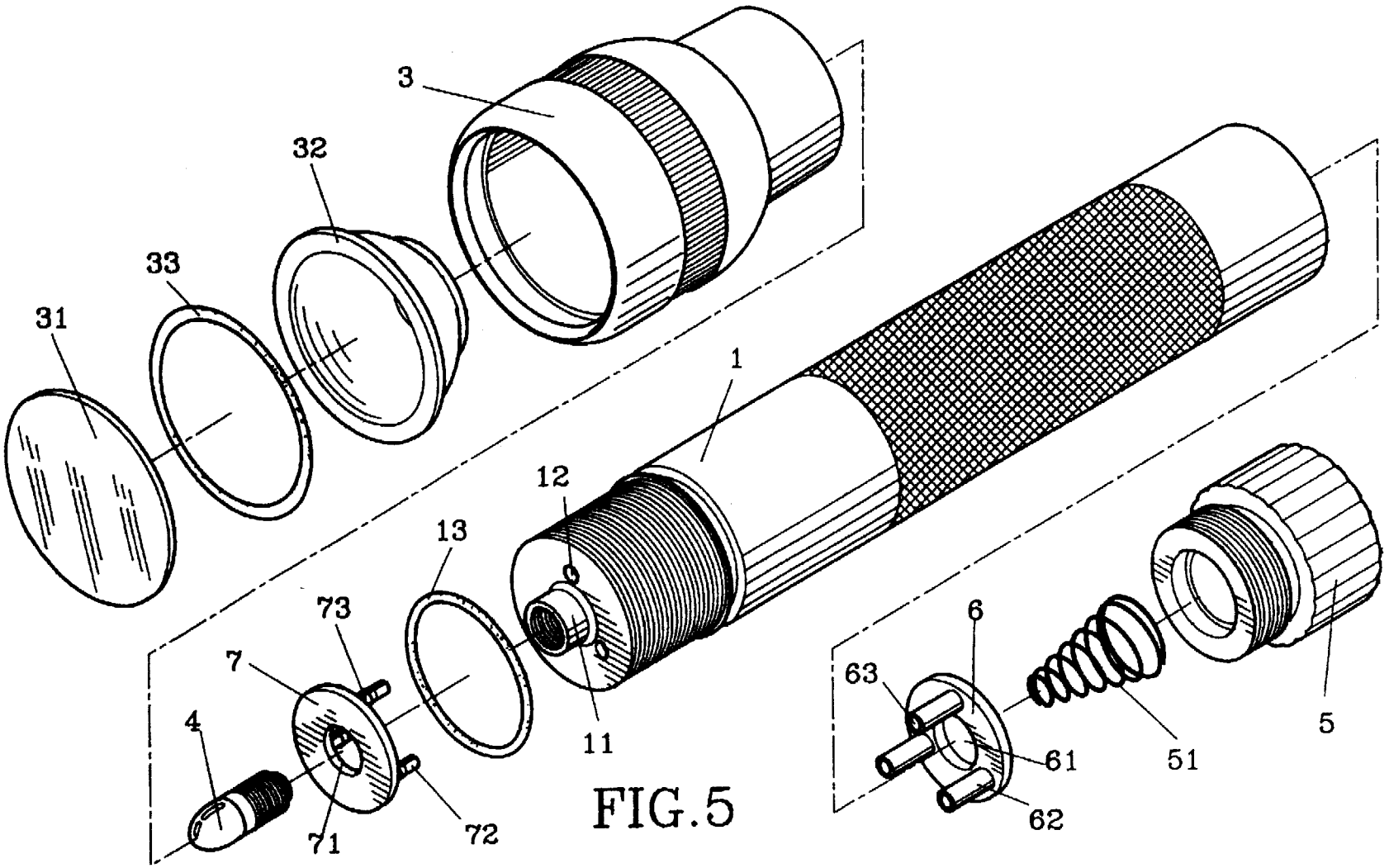
FIG. 5 is an exploded perspective view of a second embodiment of a turn-on-and-off device for a flashlight in the present invention.
Figure 6:
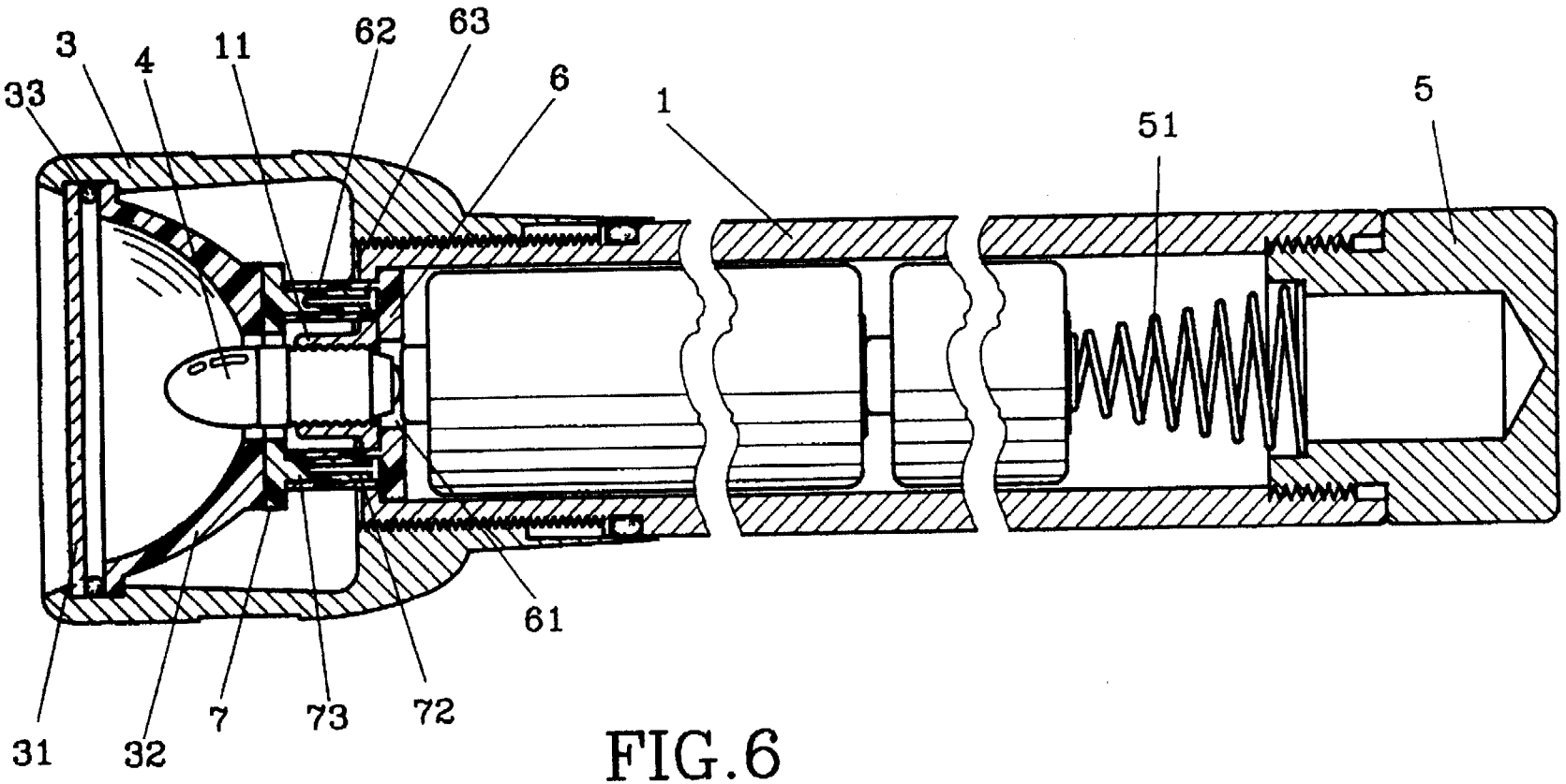
FIG. 6 is a cross-sectional view of the second embodiment of a turn-on-and-off device for a flashlight in the present invention, showing it being in turn-on condition.
Figure 7:
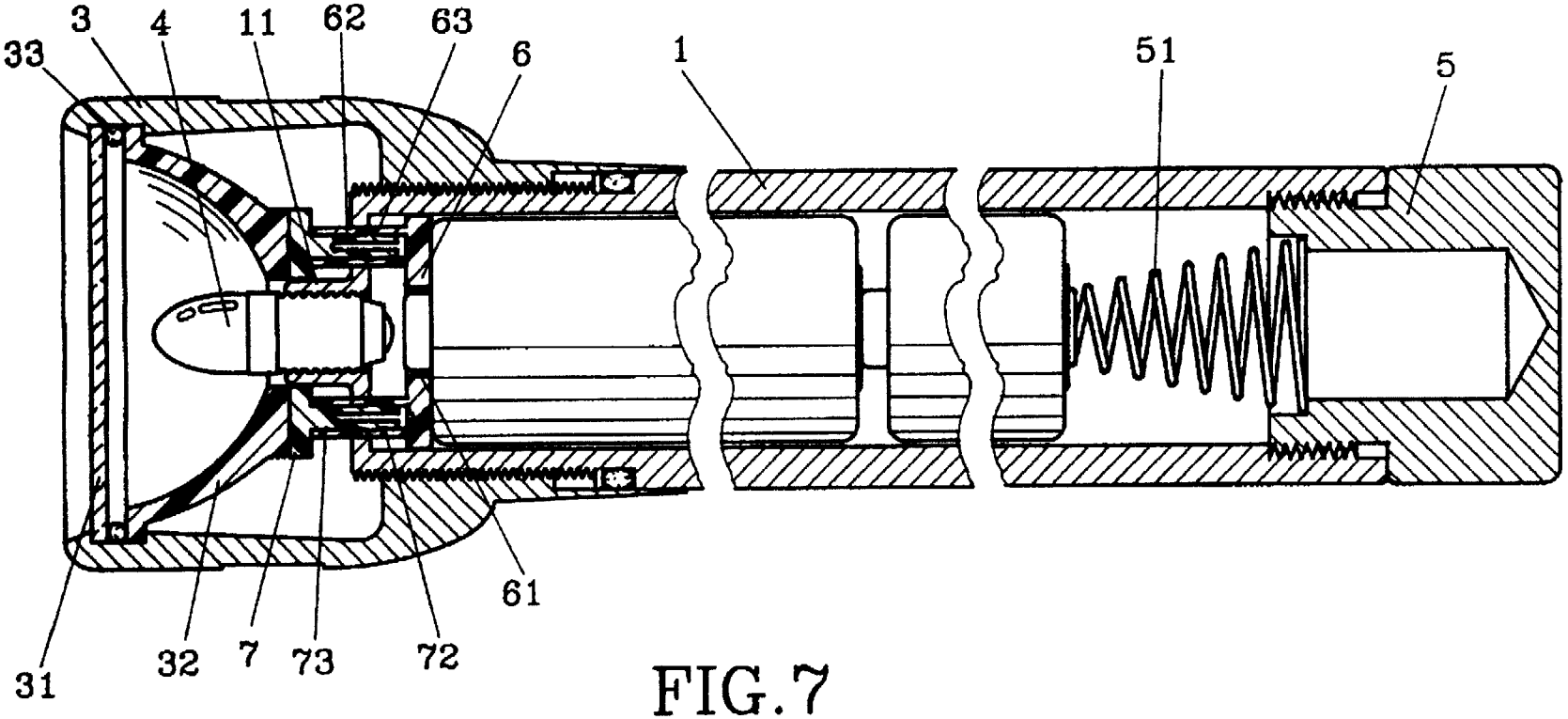
FIG. 7 is a cross-sectional view of the second embodiment of a turn-on-and-off device for a flashlight in the present invention, showing it being in turned-off condition.

A second embodiment of the turn-on-and-off device for a turn-on-and-off device for a flashlight in the present invention, as shown in FIGS. 5, 6 and 7 has the same structure as the first embodiment except a front actuating disc 7 and a rear actuating disc 6 instead of the actuating disc 2 of the first embodiment.

The front actuating disc 7 is located in front of the casing 1 as the actuating disc 2 of the first embodiment, but the rear actuating disc 6 is located inside of the casing 1 and in front of the foremost battery 40. The front actuating disc 7 has a center hole 71 for the lamp body to pass through and three rod posts 72 extending laterally rearward and spaced apart equidistantly and respectively having a diametric deep slot. Each rod post 73 has a little larger diameter annular projection 73 near the end. The rear actuating disc 6 has a center hole 62 for the lamp body to pass through and three tubular posts 62 extending forward and spaced apart equidistantly. The three tubular posts 62 respectively have an annular groove 63 in an intermediate portion to engage with the annular projections 73 of the three rod posts 72 after they pass forward through the position holes 12 of the casing 1, so the front actuating disc 7 and the rear actuating disc 6 may be united securely and move together, and then they are pushed by the lamp housing 3 for turning on and off the lamp 4 as the actuating disc 2 is pushed by the lamp housing 3 in the first embodiment.

While the preferred embodiments of the invention have been described above, it will be recognized and understood that various modifications may be made therein and the appended claims are intended to cover all such modifications which may fall within the spirit and scope of the invention.

What is claimed is:

1. A turn-on and turn-off device for a flashlight, which has a casing, a gasket fixed at a front end of said casing, a lamp housing screwed with a front end section of said casino and a tail cap screwed with a rear end of said casing, comprising;

an actuating disc having a center hole for a lamp to pass through and three posts extending laterally rearward and spaced apart equidistantly, each said post having a larger diameter annular projection near an end;

said casing having a lamp holder fixed on a front end surface, three position holes in said front end spaced apart equidistantly between said lamp holder and a front peripheral edge of said casing; and characterized by said actuating disc being located in front of said casing, with said three posts of said actuating disc extending through said three position holes in an interior of said casing and secured in that position by means of said larger diameter annular projections, said actuating disc with said three posts being able to be moved forward and rearward by said lamp housing when said lamp housing is screwed to move forward and rearward, said three posts being in a forward position to permit, a positive pole of a foremost battery contact with a bottom of said lamp, which is then lit up, said three posts being in a rearward position to push said foremost battery rearward and to force said positive pole of said foremost battery separated from said bottom of said lamp, which is then turned off.

2. The turn-on-and-off device for a flashlight as claimed in claim 1, wherein said actuating disc is replaced by;

a rear actuating disc being located inside said casing in front of batteries placed in line in said casing, having a center hole for a lamp to pass through and three tubular posts extending laterally forward and passing forward through said three position holes of said casing, each said tubular post having an annular groove; and a front actuating disc being located in front of said casing, having a center hole for said lamp to pass through, three rod posts extending rearward, spaced apart equidistantly, respectively having a diametric deep slot and a little larger diameter annular projection, said three rod posts fitting in said three tubular posts of said rear actuating disc, with said little larger diameter annular projection engaging said annular groove of each said rod post of said rear actuating disc to secure said front actuating disc with said rear actuating disc so that both said front and said rear actuating disc may move together in said three position holes of said casing when being moved by said lamp housing.

* * * * *